US006803893B1

(12) United States Patent
Hwang

(10) Patent No.: US 6,803,893 B1
(45) Date of Patent: Oct. 12, 2004

(54) SCAN RATE CONTROLLER

(75) Inventor: Ho-Dae Hwang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 08/992,955

(22) Filed: Dec. 18, 1997

(30) Foreign Application Priority Data

Dec. 18, 1996 (KR) ..... 96-067469

(51) Int. Cl.[7] ..... G09G 3/36
(52) U.S. Cl. ..... 345/88; 345/99; 345/213
(58) Field of Search ..... 345/127, 129, 345/130, 439, 507, 509, 510, 89, 98, 99, 536, 537, 539, 540, 545, 546, 549, 213; 348/500, 505, 510, 513

(56) References Cited

U.S. PATENT DOCUMENTS 5,629,781 A * 5/1997 Ueno et al. ..... 358/523
5,721,565 A * 2/1998 Nguyen ..... 345/127
5,781,165 A * 7/1998 Tabata ..... 345/8
5,790,096 A * 8/1998 Hill, Jr. ..... 345/150
5,844,533 A * 12/1998 Usui et al. ..... 345/89
5,844,538 A * 12/1998 Shiraki et al. ..... 345/98
5,874,937 A * 2/1999 Kesatoshi ..... 345/127
5,914,711 A * 6/1999 Mangerson et al. ..... 345/508
5,929,923 A * 7/1999 Yamauchi et al. ..... 345/133

* cited by examiner

*Primary Examiner*—Xiao Wu
(74) *Attorney, Agent, or Firm*—Robert E. Bushnell, Esq.

(57) ABSTRACT

A scan rate controller includes a write phase lock loop for generating a write clock signal, a read timing generator for generating a fixed read timing clock signal, and a frame memory for storing a video signal according to the write clock signal from the write phase lock loop and a write timing clock signal from a timing generator, and outputting the video signal according to the read timing clock signal from read timing generator, thereby converting an image size in accordance with various video modes into an image size corresponding to a fixed video mode.

9 Claims, 6 Drawing Sheets

SVGA(800 X 600)

XGA(1024 X 768)

EWS(1280 X 1024)

SCAN RATE CONTROLLER

CLAIM OF PRIORITY

This application makes reference to, incorporates the same herein, and claims all benefits accruing under 35 U.S.C §119 from an application entitled *Scan Rate Controller* earlier filed in the Korean Industrial Property Office on 18 Dec. 1996, and there duly assigned Ser. No. 96-67469 by that Office.

BACKGROUND OF THE INVENTION

1. Field of the Invention

The present invention relates to a scan rate controller, specifically, to a scan rate controller which fixes a frame rate, in accordance with various video modes, to one frequency.

2. Discussion of Related Art

A general personal computer (PC) displays a video signal generated by a video card placed in the computer body on a display monitor employing a cathode ray tube (CRT), to allow a user to confirm the desired output of video data. The display monitor widely used consumes a large amount of power, and has a large volume. Thus, it is difficult to use such a display monitor with a portable computer. To overcome this problem, a flat panel display (FPD) has been developed.

There are various kinds of FPDs, such as thin film displays using plasma, liquid crystal displays (LCD), and light emitting diode displays. The commercially available LCD is frequently used as the monitor of a notebook computer. A LCD with a large picture size corresponding to a general TV picture size is currently being developed.

The configuration of a conventional LCD monitor circuit is explained below with reference to the attached drawing FIG. 1. Referring to FIG. 1, a PC 100 includes a CPU 110 for receiving and processing a keyboard signal input by a user, and for generating data according to the processed result, and includes a video card 120 for receiving the data generated by CPU 110, processing it as a RGB video signal, and outputting a horizontal synchronous signal H-SYNC and a vertical synchronous signal V-SYNC for synchronizing the video signal.

A LCD monitor 200 receiving the RGB video signal, horizontal and vertical synchronous signals H-SYNC and V-SYNC from video card 120 in PC 100 includes: an amplifier 201 for receiving the RGB video signal from video card 120, and amplifying it; a first analog/digital converter (A/D converter) 202 for converting the analog RGB video signal output from amplifier 201 to a digital video signal; a synchronous signal detector 203 for separately detecting horizontal and vertical synchronous signals H/V-SYNC output from video card 120; a first phase locked loop (PLL) 204 for receiving horizontal and vertical synchronous signals H/V-SYNC detected by synchronous signal detector 203 and generating a clock frequency according to the horizontal and vertical synchronous signals; a microcomputer 205 which contains a digital/analog converter (D/A converter) for converting a digital signal to an analog signal, and generates on screen display (OSD) data; an OSD unit 206 for receiving the OSD data from microcomputer 205, and outputting the OSD data as an OSD signal; a second A/D converter 207 for receiving the OSD signal from OSD unit 206, and converting the OSD signal to a digital signal; a multiplexer 208 for receiving the OSD signal from second A/D converter 207 and RGB video signal from first A/D converter 202, and selectively outputting them; a first gate array 209 for setting output timing of the video signal and OSD signal selectively output from multiplexer 208; a second gate array 210 for storing and converting the RGB video signal output from first gate array 209; and a LCD panel 211 for receiving the video signal from second gate array 210, and displaying it.

The operation of the aforementioned conventional LCD monitor is explained below. When a user inputs data into PC 100 in order to execute a program, CPU 110 executes the program according to the data, and outputs video data according to the executed result to video card 120. Video card 120 processes the video data to generate a video signal. Video card 120 also generates horizontal and vertical synchronous signals H/V-SYNC for synchronizing the RGB video signal. The video signal is sent from video card 120 to amplifier 201 which amplifies the video signal. The amplified video signal is an analog signal and is converted into a digital RGB video signal by first A/D converter 202, and the digital video signal is sent to multiplexer 208.

Synchronous signal detector 203 detects horizontal and vertical signals H/V-SYNC for synchronizing the video signal output from video card 120 in PC 100, and sends the detected signals to PLL 204. PLL 204 outputs a predetermined clock frequency using the horizontal and vertical synchronous signals. The clock frequency is applied to A/D converter 202. The analog RGB video signal is sampled by A/D converter 202 according to the clock frequency, and the sampled video signal, i.e., the digital RGB video signal, is sent to multiplexer 208.

Microcomputer 205 containing an OSD control program and, in response to a received OSD control signal (not shown), generates the OSD signal according to the OSD control signal. The OSD signal is an analog signal and is converted into a digital signal by second A/D converter 207.

Multiplexer 208 receives the digital OSD signal output from second A/D converter 207, and digital RGB video signal output from first A/D converter 203. The digital OSD signal and digital RGB video signal are selectively output according to a selection signal (not shown) applied to multiplexer 208. For example, when the user uses control buttons (not shown) of LCD monitor 200 in order to display the OSD picture, an OSD selection signal from the control buttons of LCD monitor 200 is output through microcomputer 205 and OSD unit 206. The OSD selection signal is converted into a digital signal by second A/D converter 207, and sent to multiplexer 208 which selectively outputs the OSD signal according to the OSD selection signal.

When the OSD selection signal is not applied to multiplexer 208, multiplexer 208 outputs the digital RGB video signal applied from first A/D converter 203. The digital RGB video signal and digital OSD signal selectively output from multiplexer 208 are sent to first gate array 209. First gate array 209 receives the horizontal and vertical synchronous signals from PLL 204, and sets the output timing according to the horizontal and vertical synchronous signals. When the OSD function is employed, first gate array 209 outputs the digital OSD signal instead of the digital RGB video signal as a predetermined position of the LCD picture, using the horizontal and vertical synchronous signals.

Peak-to-peak voltage of the video signal generated from video card 120 is 0.7 Vpp while peak-to-peak voltage of the OSD signal output from OSD unit 206 is 5 Vpp. Thus, when multiplexer 208 switches the digital RGB video signal and the digital OSD signal, the signal processing becomes impossible because they are of different voltage values. To solve this, the peak-to-peak voltage of the video signal is amplified by amplifier 201 to 5 Vpp.

The output timing of the digital RGB video signal selectively output by multiplexer 208 is controlled by first gate array 209. The digital RGB video signal output from first gate array 209 is stored and converted by second gate array 210, and then sent to LCD panel 211 which displays the digital RGB video signal. The resolution of an LCD monitor on which the RGB picture signals are displayed can be 640×480 for the VGA (Video Graphics Array) mode, 800×600 for the SVGA (Super Video Graphics Array) mode, 1024×768 for the XGA (Extended Graphics Array) mode, or 1280×1024 for the EWS mode. The resolution of the SVGA (800×600) mode means that the LCD monitor contains 800 pixels on the horizontal line and 600 pixels on the vertical line.

The conventional LCD monitor picture is further explained below with reference to the attached drawings. FIGS. 2A–2C show display pictures of a SVGA LCD monitor when video signals having different resolutions are input thereto. FIG. 2A illustrates the display of a picture according to the basic mode set in the SVGA LCD monitor, and in FIG. 2B the dotted lines illustrate a picture of a video signal having the XGA (102×768) video mode applied to the SVGA LCD monitor. In FIG. 2B, the object is displayed larger than the screen size can accommodate. In FIG. 2C the dotted lines illustrate a picture of a video signal in EWS (1280×1024) video mode applied to the SVGA LCD monitor. In FIG. 2C, the object is displayed even larger than the screen size can accommodate. Thus, the user cannot see a portion of the picture, which is displayed on the region beyond the monitor picture.

As described above, the conventional LCD monitor supports only single display mode, that is, one of VGA, SVGA and XGA. Accordingly, when a signal in a video mode other than the mode set to the LCD monitor is input to the monitor, the object is displayed smaller or larger than desired.

SUMMARY OF THE INVENTION

Accordingly, the present invention is directed to a scan rate controller that substantially obviates one or more of the problems due to limitations and disadvantages of the related art.

An object of the present invention is to provide a scan rate controller which converts various video mode, which is supplied from a PC, into a fixed video mode.

To achieve these and other advantages and in accordance with the purpose of the present invention, as embodied and broadly described, a scan rate controller includes a W-PLL for generating a write clock signal, a read timing generator for generating a specific read timing clock signal, and a frame memory for storing a video signal according to the write clock signal from the W-PLL and a write timing clock signal from a timing generator, and outputting the video signal according to the read timing clock signal from read timing generator.

It is to be understood that both the foregoing general description and the following detailed description are exemplary and explanatory and are intended to provide further explanation of the invention as claimed.

Additional features and advantages of the invention will be set forth in the description which follows, and in part will be apparent from the description, or may be learned by practice of the invention. The objectives and other advantages of the invention will be realized and attained by the is structure particularly pointed out in the written description and claims hereof as well as the appended drawings.

BRIEF DESCRIPTION OF THE ATTACHED DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
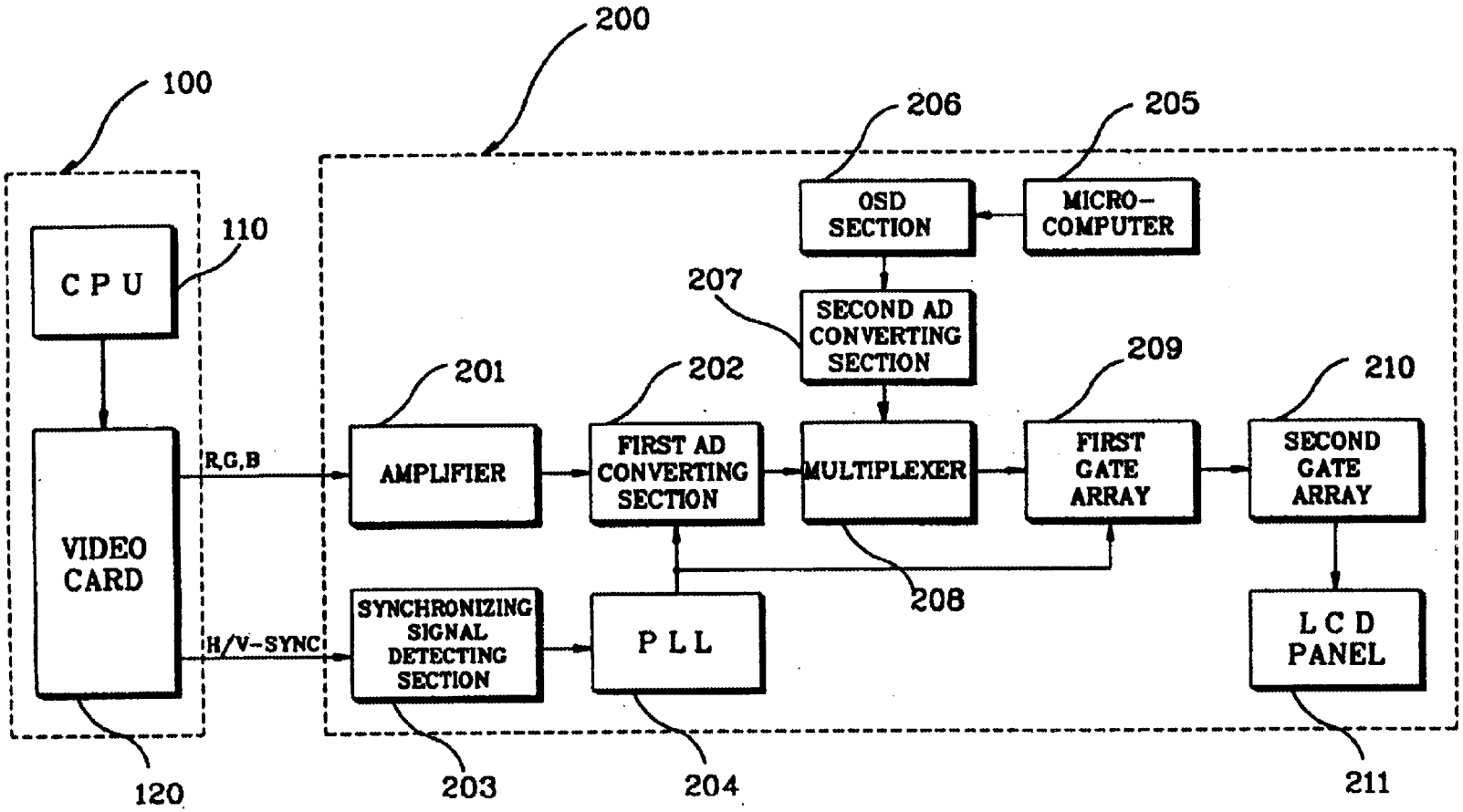
FIG. 1 (PRIOR ART)
FIG. 1 is a block diagram of a conventional LCD monitor circuit.
Figure 2A:
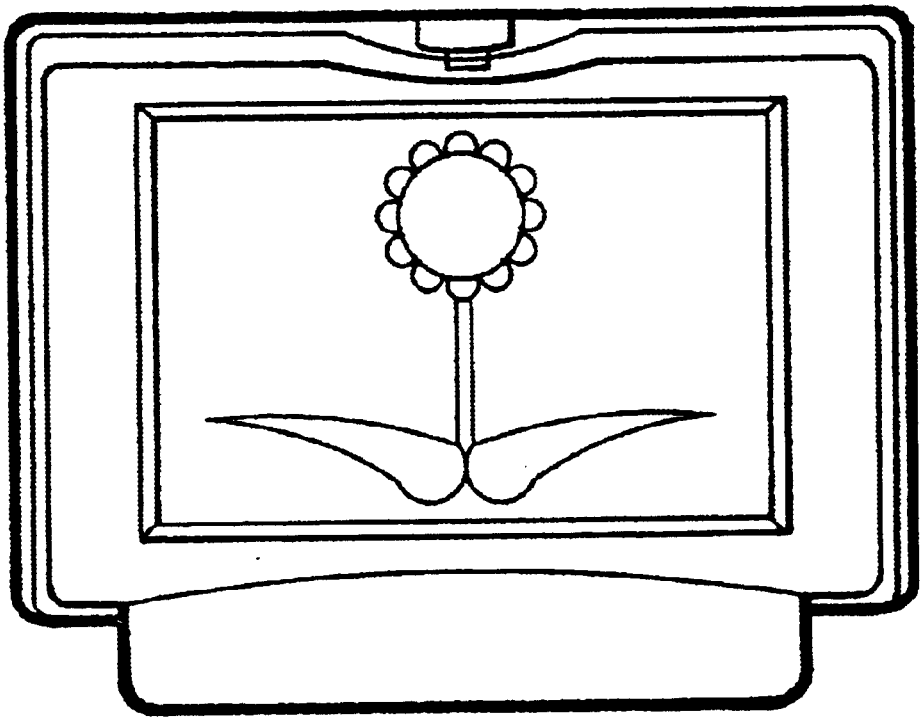
FIG. 2A (PRIOR ART)
FIGS. 2A–2C illustrate the display of a picture corresponding to video signals having different resolutions are applied to a conventional SVGA LCD monitor.
Figure 2B:
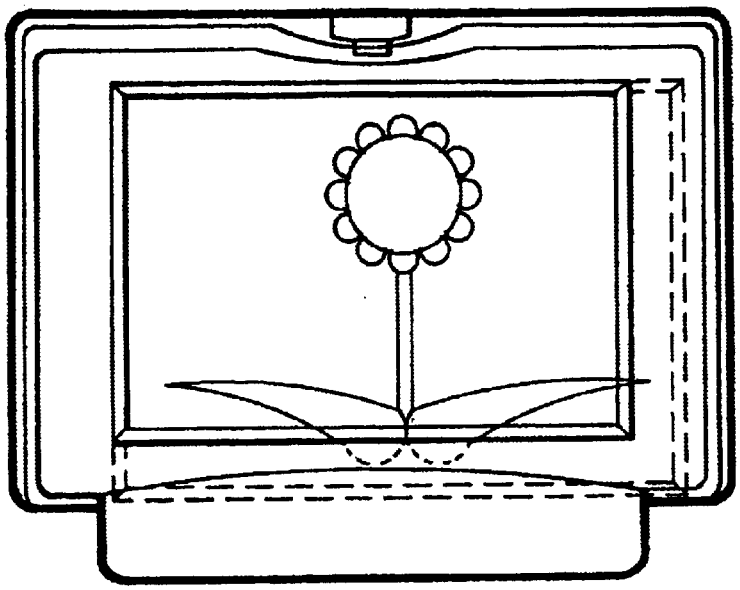
FIG. 2B (PRIOR ART)
Figure 2C:
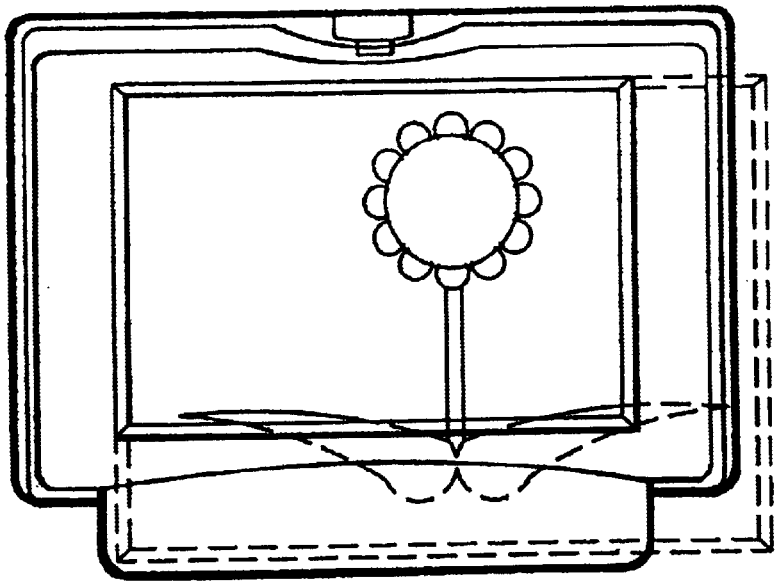
FIG. 2C (PRIOR ART)
Figure 3:
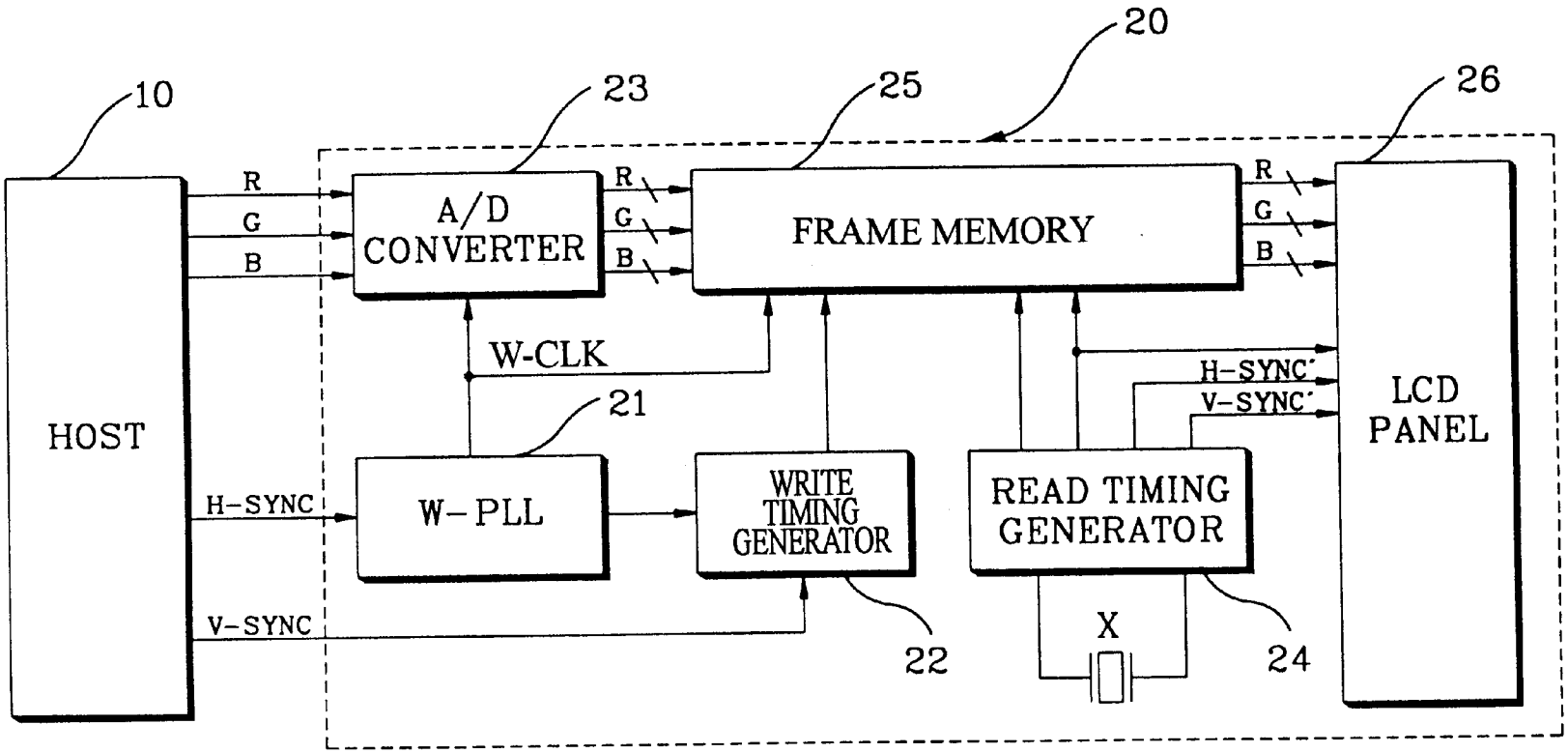
FIG. 3 is a block diagram of the internal circuit of a LCD monitor to which a scan rate controller of the present invention is applied.

FIG. 3 is a block diagram of the internal circuit of an LCD monitor to which a scan rate controller of the present invention is applied. Referring to FIG. 3, the circuit includes: a host 10 for processing input data, converting the processed data into a RGB video signal, outputting the video signal, and generating horizontal and vertical synchronous signals H/V-SYNC for synchronizing the video signal; a write phase locked loop (W-PLL) 21 for receiving horizontal synchronous signal H-SYNC from host 10, and generating a write clock signal W-CLK according to the horizontal synchronous signal; an A/D converter 23 for sampling the video signal applied from host 10 to produce a digital RGB video signal according to write clock signal W-CLK applied from W-PLL 21; a read timing generator 24 receives an oscillation signal from a crystal X, which uniformly oscillates, for generating a read timing clock signal according to the oscillation signal; a write timing generator 22 for receiving write clock signal W-CLK from W-PLL 21, and generating a write timing clock signal according to write clock signal W-CLK; a frame memory 25 for storing the digital video signal applied from A/D converter 23 according to write clock signal W-CLK from W-PLL 21 and the write timing clock signal from write timing generator 22, and outputting the digital video signal according to the read timing clock signal from read timing generator 24; and a LCD panel 26 for receiving the video signal stored in frame memory 25 according to read clock signal R-CLK from read timing generator 24, and displaying the video signal according to a read horizontal synchronous signals H-SYNC' and read vertical synchronous signal V-SYNC' which are generated by read timing generator 24.

Figure 4:
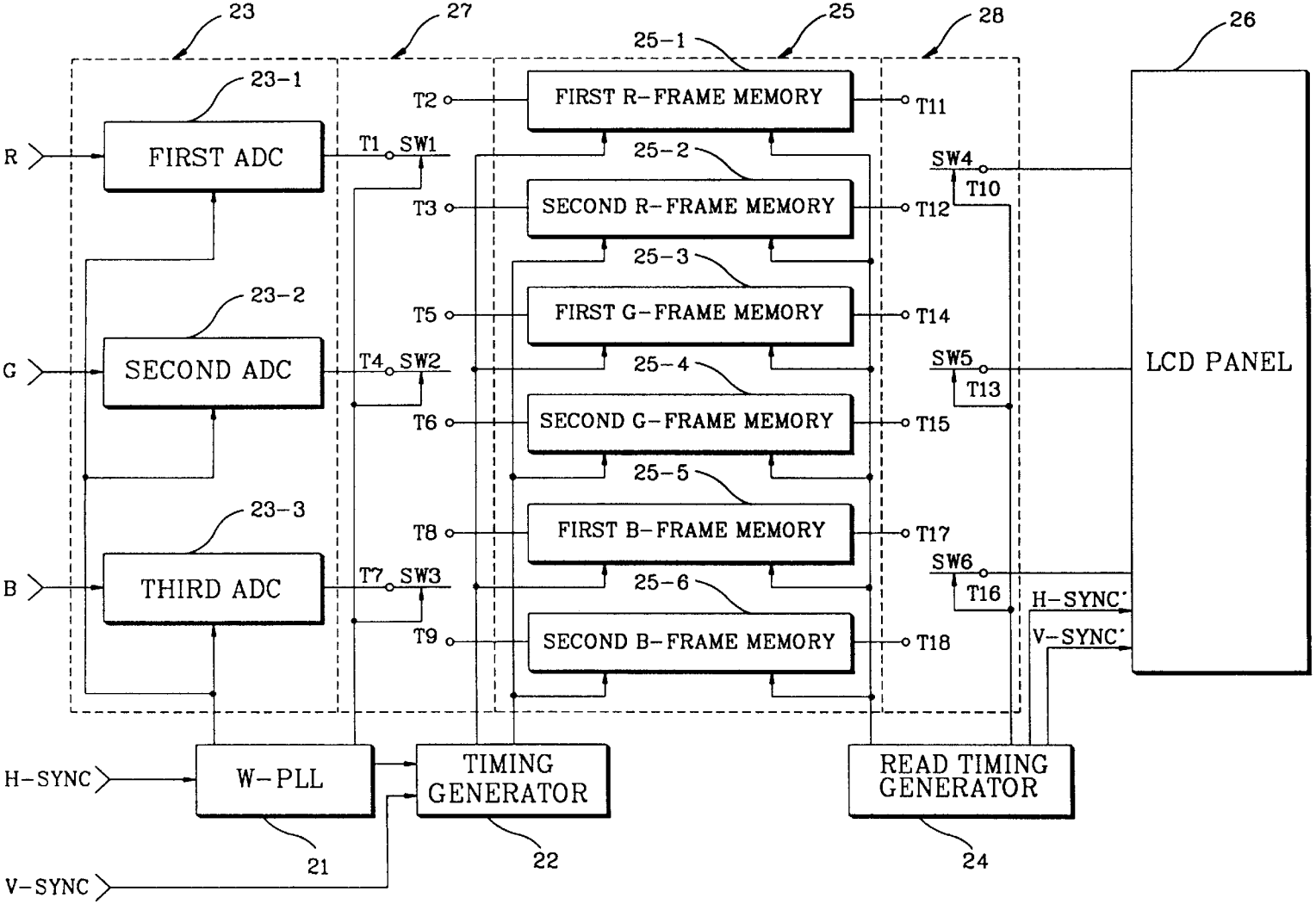
FIG. 4 is a circuit diagram of frame memory of FIG. 3.

The operation of the internal circuit of the LCD monitor is described below with reference to FIG. 4. When a user executes an operation using host 10, a video card (not shown) in host 10 converts data, applied thereto by the user, into an analog RGB video signal. Host 100 also generates horizontal and vertical synchronous signals H/V-SYNC for synchronizing the video signal. W-PLL 21 in LCD monitor 20 receives horizontal synchronous signal H-SYNC, generates write clock signal W-CLK according to the horizontal synchronous signal, and sends write clock signal W-CLK to timing generator 22 which generates the write timing clock signal according to write clock signal W-CLK.

Write clock signal W-CLK generated from W-PLL 21 is sent to A/D converter 23 which samples the analog RGB video signal sent from host 10 into a digital RGB video signal according to the write clock signal. The digital video signal is sent to frame memory 25 according to write clock signal W-CLK applied from W-PLL 21. Frame memory 25 stores the digital video signal according to the period of write clock signal W-CLK generated from timing generator 22. The digital video signal is output from frame memory 25 according to the read timing clock signal from read timing generator 24. The read timing clock signal is generated according to an oscillation frequency created by crystal X which oscillates at a fixed frequency. In other words, read timing generator 24 receives the oscillation frequency of crystal X, and generates a fixed frequency according to the oscillation frequency. Frame memory 25 receives the read timing clock signal at the fixed frequency, and outputs the video signal according to the read timing clock signal. Write clock signal W-CLK generated from timing generator 22 is a clock signal in accordance with an input video mode.

The video signal, which is stored in frame memory 25 according to write clock signal W-CLK corresponding to the input video mode, is output in a fixed display video mode according to the read timing clock signal at the fixed frequency. For example, when a video signal in SVGA(800×600) mode is supplied from host 10 to the monitor circuit fixed in XGA(1024×768) mode, read timing generator 24 outputs read clock signal R-CLK corresponding to XGA (1024×768) mode. Thus, a video signal in SVGA(800×600) mode is output according to read clock signal R-CLK corresponding to XGA(1024×768) mode. Therefore, various video modes supplied from the host are converted to a fixed video mode.

The video signal output according to read clock signal R-CLK is sent to LCD panel 26. Here, read timing generator 24 sends horizontal synchronous signal H-SYNC' and vertical synchronous signal V-SYNC' according to read clock signal R-CLK to LCD panel 26. LCD panel 26 synchronizes the video signal with horizontal and vertical synchronous signals H/V-SYNC', to display the video signal in a fixed video mode. Accordingly, the video signal in one of various video modes supplied from host 10 is output as the video signal in a fixed video mode.

A circuit for fixing the input video signals of various video modes into a specific video mode is explained below with reference to the attached drawing. FIG. 4 is a circuit diagram showing the frame memory in FIG. 3. Referring to FIG. 4, A/D converter 23, which receives write clock signal W-CLK from W-PLL and converts the analog video signal applied from host 10 into the digital video signal according to the period of the write clock signal pulse, includes a first ADC 23-1 for receiving the R signal component of the analog RGB video signal, and converting it into a digital signal, a second ADC 23-2 for receiving the G signal component and converting it into a digital signal, and a third ADC 23-3 for receiving the B signal component and converting it into a digital signal.

A first switching unit 27, which switches the video signal output from A/D converter 23 according to write clock signal W-CLK from W-PLL 21, includes a first switch SW1 for receiving and switching the digital R signal from first ADC 23-1, a second switch SW2 for receiving and switching the digital G signal, and a third switch SW3 for receiving and switching the digital B signal. Frame memory 25, which receives and stores the digital RGB video signal output from first switching unit 27, includes first and second R-frame memories 25-1 and 25-2 for receiving the digital R signal from first switch SW1, and storing it according to the write and read timing clock signals generated from write timing generator 22 and read timing generator 24, first and second G-frame memories 25-3 and 25-4 for receiving the digital G signal from second switch SW2, and storing it according to the write and read timing clock signals, and first and second B-frame memories 25-5 and 25-6 for receiving the digital B signal from third switch SW3, and storing it according to the write and read timing clock signals.

A second switching unit 28, which switches the video signal output from frame memory 25 according to the read timing clock signal, includes a fourth switch SW4 for switching the stored R signal sent from first and second R-frame memories 25-1 and 25-2, a fifth switch SW5 for switching the stored G signal sent from first and second G-frame memories 25-3 and 25-4, and sixth switch SW6 for switching the stored B signal sent from first and second B-frame memories 25-5 and 25-6. LCD panel 26 receives and displays the digital RGB video signal applied from second switching unit 28 in response to read horizontal synchronous signal H-SYNC' and read vertical synchronous signal V-SYNC' from read timing generator 24.

The operation of the LCD monitor circuit according to the present invention is explained below. First of all, host 10 converts data input by execution of a known program into an analog RGB video signal, and sends the video signal to A/D converter 23. A/D converter 23 converts the analog video signal into a digital RGB video signal. In other words, first ADC 23-1 receives the R signal of the analog video signal, and samples it according to the period of write clock signal W-CLK generated by W-PLL 21, to convert it into a digital R signal. Second ADC 23-2 receives the G signal of the analog video signal, and samples it according to the write clock signal W-CLK, to convert it into a digital G signal. Third ADC 23-3 receives the B signal of the analog video signal, and samples it according to the write clock signal W-CLK, to convert it into a digital B signal. The video signal sampled according to the write clock signal W-CLK is sent to switches SW1, SW2 and SW3 in first switching unit 27.

First switching unit 27 to which the digital RGB video signal is applied receives the digital R signal at terminal T1, the digital G signal at terminal T4, and the digital B signal at terminal T7. The digital R, G and B video signal components, applied to terminals T1, T4 and T7 of switches SW1, SW2 and SW3, respectively, are switched according to the period of write clock signal W-CLK from W-PLL 21, and selectively applied to terminals T2 or T3, T5 or T6, and T8 or T9, respectively, of switches SW1, SW2 and SW3. Accordingly, the digital R signal applied through terminal T1 of switch SW1 is selectively sent to first or second R-frame memories 25-1 and 25-2 by selectively switching between terminals T2 and T3 according to write clock signal W-CLK from W-PLL 21. The digital G signal applied through terminal T4 of switch SW2 is selectively sent to first or second G-frame memories 25-3 and 25-4 by selectively switching between terminals T5 and T6 according to write clock signal W-CLK from W-PLL 21. The digital B signal applied through terminal T7 of switch SW3 is selectively sent to first or second B-frame memories 25-5 and 25-6 by selectively switching between terminals T8 and T9 according to write clock signal W-CLK from W-PLL 21.

When the read timing clock signal generated from read timing generator 24 is sent to second R-frame memory 25-2, frame data for a picture in accordance with the R signal stored in second R-frame memory 25-2 is output. While the R signal is supplied to first R-frame memory 25-1, and one frame of data constructed of the R signal is stored, second frame memory 25-2 outputs the frame data constructed of R signal through a terminal T12 of fourth switch SW4 in second switching unit 29. The frame data output through terminal T12 is coupled to terminal T10 by switching fourth switch SW4 to which the read timing clock signal is applied. The R signal frame data is output according to the fixed period of read timing clock signal. When output of the R signal frame data from second R-frame memory is completed, terminal T11 is coupled to terminal T10 by switching fourth switch SW4 according to the read timing clock signal. By doing so, the R signal frame data stored in first R-frame memory 25-1 is read according to the fixed period of the read timing clock signal, and output through fourth switch SW4. Similar read/write operations are carried out with respect to the digital G signal and the digital B signal and the corresponding frame memories and switches.

As described above, write/read operations of data are sequentially carried out through first and second R-frame memories 25-1 and 25-2, to output the video signal in a video mode provided by host 10 as a video signal in a fixed video mode having a resolution according to LCD panel 26. For example, in case of fixed video mode of VGA(600×600), when a video signal in EWS(1280×1024) mode with higher resolution is supplied to the monitor, frame data is omitted. When a video signal in VGA(600×480) mode with lower resolution is supplied to the monitor, data of one frame is added. That is, the video signal data stored in frame memory 25 is output in a fixed video mode by controlling read scan rate according to the video mode applied with the video signal.

As described above, data of one frame constructed of R signal is omitted or added according to the video mode applied to frame memory 25, to output the video signal in a fixed video mode through second switching unit 29. The G signal and B signal also pass through the same operation as the aforementioned one, to be output through terminals T13 to T18 of switches SW5 and SW6 in second switching unit 29. The R,G,B signals output through second switching unit 29 are sent to LCD panel 26. LCD panel 26 also receives read horizontal and vertical synchronous signals H/V-SYNC' in accordance with the fixed read clock timing clock signal sent from read timing generator 24, and displays the video signal applied thereto.

Figure 5A:
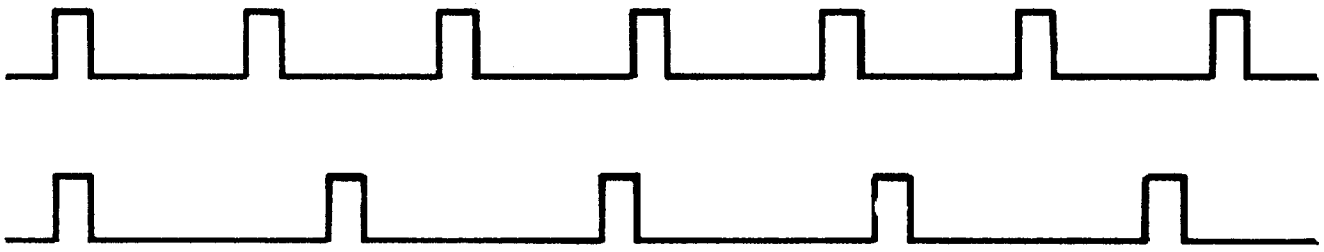
FIG. 5A shows a waveform for converting a high-resolution video mode to a fixed video mode.

Waveforms according to the frame rate are described below with reference to FIGS. 5A and 5B. FIG. 5A is a waveform diagram showing the output of fixed video mode according to high-resolution video mode. FIG. 5A shows a waveform for converting a high-resolution video mode supplied from host 10 (shown in FIG. 3) into a fixed video mode. When vertical synchronous signal V-SYNC synchronizing the video signal sent to frame memory 25 is 70 Hz, fixed read vertical synchronous signal V-SYNC' is output at 60 Hz, to thereby omit one frame. That is, 7, the number of pulse period of vertical synchronous signal V-SYNC, is output as 6, the number of period of read vertical synchronous signal V-SYNC', to control the frame rate of video signal sent to LCD panel 26.

Figure 5B:
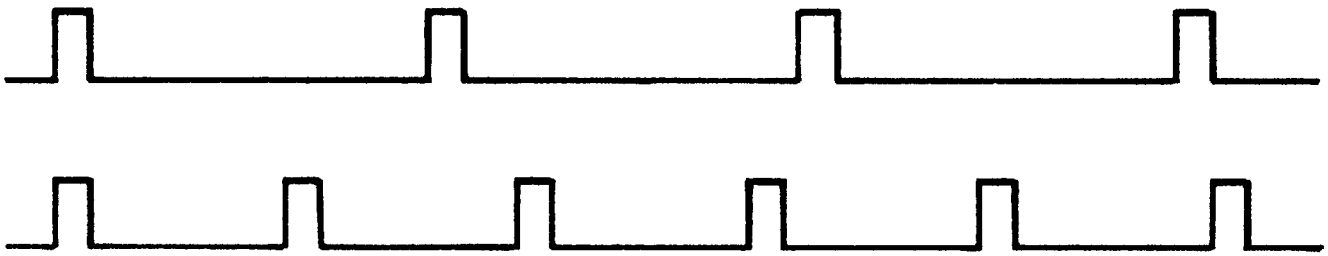
FIG. 5B shows a waveform for converting a low-resolution video mode to a fixed video mode.

FIG. 5B is a waveform diagram showing the output of fixed video mode according to a low-resolution video mode. In this case, when vertical synchronous signal V-SYNC for synchronizing the video signal sent from host 10 is in low resolution, fixed read vertical synchronous signal V-SYNC to which one frames is added is output. That is, the frame rate is reduced, and then applied to LCD panel 26, displaying the video signal. Accordingly, the video signal is output in a fixed video mode for various video modes supplied from the host.

As described above, the present invention changes various video modes supplied from the host to a fixed vide mode, to convert an image size according to various video modes to an image size in accordance with a fixed video mode.

It will be apparent to those skilled in the art that various modifications and variations can be made in the scan rate controller of the present invention without departing from the spirit or scope of the invention. Thus, it is intended that the present invention cover the modifications and variations of this invention provided they come within the scope of the appended claims and their equivalents.

What is claimed is:

1. A scan rate controller, comprising:

a write phase lock loop for receiving a horizontal synchronous signal from a host, and generating a write clock signal according to the horizontal synchronous signal;

an analog-to-digital converter for sampling a video signal supplied from the host into a digital video signal, according to the write clock signal from the write phase lock loop;

a read timing generator for receiving an oscillation signal from a crystal which oscillates uniformly, and generating a read timing clock signal, a read horizontal synchronous signal and a read vertical synchronous signal in response to the oscillation signal;

a write timing generator for receiving the write clock signal from the write phase lock loop, and generating a write timing clock signal according to the write clock signal;

a frame memory for storing the digital video signal output from the analog-to-digital converter according to the write clock signal from the write phase lock loop and the write timing clock signal from the write timing generator, and outputting the stored digital video signal according to the read timing clock signal from the read timing generator, said frame memory comprising:

first and second R-frame memories for storing and outputting a red color signal of the digital video signal, according to the write and read timing clock signals which are respectively applied from the write timing generator and read timing generator;

first and second G-frame memories for storing and outputting a green color signal of the digital video signal, according to the write and read timing clock signals which are respectively applied from the write timing generator and read timing generator; and first and second B-frame memories for storing and outputting a blue color signal of the digital video signal, according to the write and read timing clock signals which are respectively applied from the write timing generator and read timing generator; and a liquid crystal display panel for receiving the video signal from the frame memory according to a read clock signal applied from the read timing generator, and displaying the video signal according to the read horizontal and vertical synchronous signals applied from the read timing generator.

2. The scan rate controller as claimed in claim 1, said analog-to-digital converter comprising:

a first analog-to-digital converter for converting a received red color signal of said video signal supplied from the host to a digital red color signal in response to the write clock signal;

a second analog-to-digital converter for converting a received green color signal of said video signal supplied from the host to a digital green color signal in response to the write clock signal; and a third analog-to-digital converter for converting a received blue color signal of said video signal supplied from the host to a digital blue color signal in response to the write clock signal.

3. The scan rate controller as claimed in claim 2, further comprising:

a first switch for selectively providing said digital red color signal to said first and second R-frame memories in response to the write clock signal;

a second switch for selectively providing said digital green color signal to said first and second G-frame memories in response to the write clock signal;

a third switch for selectively providing said digital blue color signal to said first and second B-frame memories in response to the write clock signal;

a fourth switch for selectively providing said stored digital red color signal from said first and second R-frame memories to said liquid crystal display panel in response to the read clock signal;

a fifth switch for selectively providing said stored digital green color signal from said first and second G-frame memories to said liquid crystal display panel in response to the read clock signal; and a sixth switch for selectively providing said stored digital blue color signal from said first and second B-frame memories to said liquid crystal display panel in response to the read clock signal.

4. A scan rate controller, comprising:

a write phase lock loop for generating a write clock signal in response to a received horizontal synchronous signal from a host;

an analog-to-digital converter for generating a digital video signal by sampling, in response to said write clock signal, a video signal supplied from the host;

a write timing generator for generating a write timing clock signal in response to said write clock signal;

a uniformly oscillating crystal for generating an oscillation signal;

a read timing generator for generating a read timing clock signal, a read horizontal synchronous signal and a read vertical synchronous signal in response to said oscillation signal;

a frame memory for storing said digital video signal output from said analog-to-digital converter in response to said write clock signal and said write timing clock signal, and outputting said stored digital video signal in response to said read timing clock signal, said frame memory comprising:

first and second R-frame memories for storing and outputting a red color signal of said digital video signal, in response to said write and read timing clock signals, respectively;

first and second G-frame memories for storing and outputting a green color signal of said digital video signal, in response to said write and read timing clock signals, respectively; and first and second B-frame memories for storing and outputting a blue color signal of said digital video signal, in response to said write and read timing clock signals, respectively; and a liquid crystal display panel for receiving said video signal from said frame memory according to a read clock signal applied from said read timing generator, and displaying said video signal according to said read horizontal and vertical synchronous signals.

5. The scan rate controller as claimed in claim 4, said analog-to-digital converter comprising:

a first analog-to-digital converter for converting a received red color signal of said video signal supplied from said host to a digital red color signal in response to said write clock signal;

a second analog-to-digital converter for converting a received green color signal of said video signal supplied from said host to a digital green color signal in response to said write clock signal; and a third analog-to-digital converter for converting a received blue color signal of said video signal supplied from said host to a digital blue color signal in response to said write clock signal.

6. The scan rate controller as claimed in claim 5, further comprising:

a first switch for selectively providing said digital red color signal to said first and second R-frame memories in response to said write clock signal;

a second switch for selectively providing said digital green color signal to said first and second G-frame memories in response to said write clock signal;

a third switch for selectively providing said digital blue color signal to said first and second B-frame memories in response to said write clock signal;

a fourth switch for selectively providing said stored digital red color signal from said first and second R-frame memories to said liquid crystal display panel in response to said read clock signal;

a fifth switch for selectively providing said stored digital green color signal from said first and second G-frame memories to said liquid crystal display panel in response to said read clock signal; and a sixth switch for selectively providing said stored digital blue color signal from said first and second B-frame memories to said liquid crystal display panel in response to said read clock signal.

7. A scan rate controller, comprising:

a write phase lock loop for receiving a horizontal synchronous signal from a host, and generating a write clock signal according to the horizontal synchronous signal;

an analog-to-digital converter for sampling a video signal supplied from the host into a digital video signal, according to the write clock signal from the write phase lock loop;

a read timing generator for receiving an oscillation signal from a crystal which oscillates uniformly, and generating a read timing clock signal, a read horizontal synchronous signal and a read vertical synchronous signal in response to the oscillation signal;

a write timing generator for receiving the write clock signal from the write phase lock loop, and generating a write timing clock signal according to the write clock signal;

a frame memory for storing the digital video signal output from the analog-to-digital converter according to the write clock signal from the write phase lock loop and the write timing clock signal from the write timing generator, and outputting the stored digital video signal according to the read timing clock signal from the read timing generator, said frame memory comprising:

first and second R-frame memories for storing and outputting a red color signal of the digital video signal, according to the write and read timing clock signals which are respectively applied from the write timing generator and read timing generator;

first and second G-frame memories for storing and outputting a green color signal of the digital video signal, according to the write and read timing clock signals which are respectively applied from the write timing generator and read timing generator; and first and second B-frame memories for storing and outputting a blue color signal of the digital video signal, according to the write and read timing clock signals which are respectively applied from the write timing generator and read timing generator; and a liquid crystal display panel for receiving an additional frame of video signals from the frame memories according to a read clock signal applied from the read timing generator when a resolution of the video signal supplied from the host is less than a resolution of the liquid crystal display panel and for receiving video signals, having a frame omitted, from the frame memories according to a read clock signal applied from the read timing generator when the resolution of the video signal supplied from the host is greater than the resolution of the liquid crystal display panel, the liquid crystal display panel displaying the frames of video signals according to the read horizontal and vertical synchronous signals applied from the read timing generator.

8. The scan rate controller as claimed in claim 7, said analog-to-digital converter comprising:

a first analog-to-digital converter for converting a received red color signal of said video signal supplied from the host to a digital red color signal in response to the write clock signal;

a second analog-to-digital converter for converting a received green color signal of said video signal supplied from the host to a digital green color signal in response to the write clock signal; and a third analog-to-digital converter for converting a received blue color signal of said video signal supplied from the host to a digital blue color signal in response to the write clock signal.

9. The scan rate controller as claimed in claim 8, further comprising:

a first switch for selectively providing said digital red color signal to said first and second R-frame memories in response to the write clock signal;

a second switch for selectively providing said digital green color signal to said first and second G-frame memories in response to the write clock signal;

a third switch for selectively providing said digital blue color signal to said first and second B-frame memories in response to the write clock signal;

a fourth switch for selectively providing said stored digital red color signal from said first and second R-frame memories to said liquid crystal display panel in response to the read clock signal;

a fifth switch for selectively providing said stored digital green color signal from said first and second G-frame memories to said liquid crystal display panel in response to the read clock signal; and a sixth switch for selectively providing said stored digital blue color signal from said first and second B-frame memories to said liquid crystal display panel in response to the read clock signal.

* * * * *